US009719046B2

(12) United States Patent
Beret et al.

(10) Patent No.: US 9,719,046 B2
(45) **Date of Patent: *Aug. 1, 2017**

(54) LUBRICATING GREASE COMPOSITION

(71) Applicant: Chevron U.S.A. Inc., San Ramon, CA (US)

(72) Inventors: Samil Beret, San Ramon, CA (US); Gian Lawrence Fagan, San Ramon, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/725,808

(22) Filed: May 29, 2015

(65) Prior Publication Data

US 2015/0259621 A1 Sep. 17, 2015

Related U.S. Application Data

(63) Continuation of application No. 14/274,985, filed on May 12, 2014, now Pat. No. 9,096,814, which is a continuation of application No. 13/192,094, filed on Jul. 27, 2011, now abandoned.

(51) Int. Cl.

| | |
|---|---|
| ***C10M 169/06*** | (2006.01) |
| ***C10M 117/02*** | (2006.01) |
| ***C10M 125/22*** | (2006.01) |
| ***C10M 135/20*** | (2006.01) |
| ***C10M 169/00*** | (2006.01) |

(52) U.S. Cl.

CPC ..... *C10M 169/06* (2013.01); *C10M 169/00* (2013.01); *C10M 2201/066* (2013.01); *C10M 2205/0206* (2013.01); *C10M 2205/0285* (2013.01); *C10M 2207/1206* (2013.01); *C10M 2207/1236* (2013.01); *C10M 2207/1276* (2013.01); *C10M 2207/1285* (2013.01); *C10M 2219/022* (2013.01); *C10M 2219/024* (2013.01); *C10M 2219/082* (2013.01); *C10M 2223/04* (2013.01); *C10M 2223/043* (2013.01); *C10M 2223/047* (2013.01); *C10N 2220/022* (2013.01); *C10N 2220/082* (2013.01); *C10N 2230/06* (2013.01); *C10N 2240/02* (2013.01); *C10N 2250/10* (2013.01)

(58) Field of Classification Search

CPC ..... C10M 169/06; C10M 2205/066; C10M 169/00; C10M 2201/066; C10M 2205/0285; C10M 2207/1206; C10M 2207/1236; C10M 2207/1276; C10M 2207/1285; C10M 2219/022; C10M 2219/024; C10M 2219/082; C10M 2223/04; C10M 2223/043; C10M 2223/047; C10N 2250/10; C10N 2220/022; C10N 2220/082; C10N 2230/06; C10N 2240/02

USPC ..... 508/167, 549, 569

See application file for complete search history.

(56) References Cited

U.S. PATENT DOCUMENTS

| | | | | |
|---|---|---|---|---|
| 5,110,489 | A * | 5/1992 | Stadler | C10M 143/02 508/236 |
| 6,444,621 | B1 * | 9/2002 | Okaniwa | C10M 169/06 508/168 |
| 9,096,814 | B2 * | 8/2015 | Beret | C10M 169/06 |
| 2001/0007832 | A1 | 7/2001 | Takabe et al. | |
| 2004/0092408 | A1 * | 5/2004 | Willey | C10M 169/02 508/165 |
| 2005/0133265 | A1 * | 6/2005 | Denton | C10M 169/00 175/57 |
| 2010/0197540 | A1 * | 8/2010 | Shan | C08L 53/00 508/591 |

FOREIGN PATENT DOCUMENTS

| | | |
|---|---|---|
| EP | 0191608 | 8/1986 |

* cited by examiner

*Primary Examiner* — James Goloboy

(74) *Attorney, Agent, or Firm* — Melissa M. Hayworth; E. Joseph Gess; Susan M. Abernathy

(57) ABSTRACT

A lubricating grease composition for extra heavy duty extreme pressure applications comprises a major amount of a synthetic base oil a lithium complex thickener, at least one extreme pressure agent; and at least 5 wt. % of molybdenum disulfide, based on a total weight of the lubricating grease composition.

20 Claims, No Drawings

LUBRICATING GREASE COMPOSITION

RELATED APPLICATIONS

This application is a continuation of U.S. patent application Ser. No. 14/274985 filed May 12, 2014, which is a continuation of U.S. patent application Ser. No. 13/192094 filed Jul. 27, 2011, both entitled "Lubricating Grease Composition", the entire disclosures of which are herein incorporated by reference in their entireties.

TECHNICAL FIELD

This application generally relates to lubricating grease compositions for extreme pressure applications.

BACKGROUND

The need for high performance grease compositions capable of supplying good wear properties over a broad temperature range and under extreme pressures is well established.

Specialized greases have been developed to meet the extra heavy duty performance requirements for mining and off-road construction equipment. These greases are employed in a wide range of applications where heavy pressures exist, including pins and bushings on bucket and loaders, shaker screens, crushers, conveyers and heavy equipment lubrication systems which involve pumping grease through long supply lines at low temperatures.

A key feature for remote applications is that the grease provides excellent low temperature pumpability and start-up. The grease should not soften and run under operating conditions encountered at higher temperatures so as to maintain an environmentally safe product, and yet, should as well exhibit good low temperature pumpability at lower temperatures. However, the features that afford warm weather adherence or stayability can impede low temperature performance and handling.

In addition, it is highly desirable that the grease provides excellent extreme pressure protection. This property is critical in that many of the lubrication points causing the most difficulty are pin and bushing assemblies which are subjected to oscillatory motion and shock loading. Such motion can result in loss of lubricant from the contact zone if the grease is overly fluid or insufficiently tacky, leading to early component failure and costly unplanned downtime.

Due to ever increasing demands for higher performance, it would be desirable to provide greases which exhibit improved lubrication properties, and in particular, improved low temperature pumpability and product adherence along with excellent extreme pressure performance.

SUMMARY

In one aspect, we provide a lubricating grease composition comprising a major amount of a synthetic base oil, a lithium complex thickener, at least one extreme pressure agent, and at least 5 wt. % of molybdenum disulfide, based on a total weight of the lubricating grease composition.

In another aspect, we provide a method of making a lubricating grease composition which comprises blending together a major amount of a synthetic base oil, a lithium complex thickener, at least one extreme pressure agent, and at least 5 wt. % of molybdenum disulfide, based on a total weight of the lubricating grease composition.

In yet another aspect, we provide a method of lubricating bearings, surfaces and other lubricated components comprising use of a lubricating grease composition which comprises a major amount of a synthetic base oil, a lithium complex thickener, at least one extreme pressure agent, and at least 5 wt. % of molybdenum disulfide, based on a total weight of the lubricating grease composition.

DETAILED DESCRIPTION

Oil of Lubricating Viscosity

The lubricating grease composition comprises a major amount of a synthetic base oil. As used herein, the term "major amount" refers to a concentration of the base oil within the lubricating grease composition of at least about 50 wt. %. The amount of base oil in the lubricating grease composition ranges from 50 to 95 wt. %, typically from 55 to 90 wt. %, and often from 60 to 85 wt. %, based on a total weight of the lubricating grease composition.

Synthetic base oils include hydrocarbon oils such as olefin oligomers (including polyalphaolefin base oils), halo-substituted hydrocarbon oils, alkylene oxide polymers, esters of carboxylic acids and polyols, esters of polycarboxylic acids and alcohols, esters of phosphorus-containing acids, polymeric tetrahydrofurans, silicone-based oils and mixtures thereof.

In one embodiment, the synthetic base oil comprises at least one polyalphaolefin base oil. Polyalphaolefin base oils (PAOs) and their manufacture are well known in the art. PAOs are generally derived from monomers having from about 4 to about 30 carbon atoms, typically from about 4 to about 20 carbon atoms, and often from about 6 to about 16 carbon atoms. Suitable PAOs can include those derived from 1-hexene, 1-octene, 1-decene, or mixtures thereof. These PAOs can have a kinematic viscosity in the range from 5 to 1500 $mm^2/s$ at 40° C.

In one embodiment, the base oil is a high viscosity base oil having a kinematic viscosity at 40° C. greater than 100 $mm^2/s$. In another embodiment, the base oil is a blend of different base oils, with the different base oils all having a kinematic viscosity at 40° C. greater than 25 $mm^2/s$, wherein the blend has a kinematic viscosity at 40° C. greater than 100 $m^2/s$.

In one embodiment, the base oil has a kinematic viscosity at 40° C. from 30 $mm^2/s$ to 600 $mm^2/s$; in another embodiment, from 100 to 300 $mm^2/s$; and in yet another embodiment, from 150 $mm^2/s$ to 250 $mm^2/s$.

Complex Soap Thickener

In addition to the base oil, the lubricating grease composition comprises a thickener system comprising a lithium soap of a $C_{12}$ to $C_{24}$ hydroxy carboxylic acid and a lithium soap of a $C_2$ to $C_{12}$ dicarboxylic acid.

Suitable $C_{12}$ to $C_{24}$ hydroxy carboxylic acids can include 12-hydroxystearic acid, 12-hydroxyricinoleic acid, 12-hydroxybehenic acid and 10-hydroxypalmitic acid. In one embodiment, the $C_{12}$ to $C_{24}$ hydroxy fatty acid is 12-hydroxystearic acid.

The $C_2$ to $C_{12}$ dicarboxylic acid can be a $C_4$ to $C_{12}$, or a $C_6$ to $C_{10}$, aliphatic dicarboxylic acid. Suitable $C_2$ to $C_{12}$ dicarboxylic acids include oxalic acid, malonic acid, succinic acid, glutaric acid, adipic acid, suberic acid, pimelic acid, azelaic acid, dodecanedioic acid and sebacic acid. In one embodiment, azelaic acid or sebacic acid is used.

In one embodiment, the amount of lithium complex thickener in the lubricating grease composition ranges from 2 to 30 wt. %, from 5 to 20 wt. %, or 10 to 15 wt. %, based on a total weight of the lubricating grease composition.

Extreme Pressure Agent

Examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and mono-unsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and polysulfide olefin products, amine salts of phosphoric acid esters or thiophosphoric acid esters and the like and combinations thereof The amount of the extreme pressure agent in the lubricating grease composition ranges from 0.25 to 5 wt. %, typically from 0.5 to 3 wt. %, based on a total weight of the lubricating grease composition.

Molybdenum disulfide

Molybdenum disulfide is widely used as a solid lubricant because of its low friction properties. Molybdenum disulfide has a lamellar lattice-like structure and it can easily shear between sliding surfaces to reduce friction. The molybdenum disulfide generally has an average primary particle size of about 30 μm or less, typically from 0.1 to 20 μm.

The amount of molybdenum disulfide in the lubricating grease composition is at least 5 wt. %, e.g., from 5 to 20 wt. %, based on a total weight of the lubricating grease composition. In other embodiments, the amount of molybdenum disulfide in the lubricating grease composition ranges from 5 to 15 wt. %; or from 5 to 10 wt. %, based on a total weight of the lubricating grease composition.

Optional Additives

Various other grease additives can be incorporated into the lubricating grease composition, in amounts sufficient to impart the desired effects (e.g., oxidation stability, tackiness, etc.). Suitable additives include fungicides and antibacterial agents; colorants; shear stability additives; anti-wear/anti-weld agents; flame retardants such as calcium oxide; oiliness agents; corrosion inhibitors such as alkali metal nitrite, e.g. sodium nitrite; oil bleed inhibitors such as polybutene; foam inhibitors such as alkyl methacrylate polymers and dimethyl silicone polymers; oxidation inhibitors such as hindered phenols or amines, e.g. phenyl alpha naphthylamine; metal deactivators such as disalicylidene propylenediamine, triazole derivatives, thiadiazole derivatives, mercaptobenzimidazoles; complex organic nitrogen, and amines; friction modifiers; thermal conductive additives; electroconductive agents; elastomeric compatibilizers; viscosity modifiers such as polymethacrylate type polymers, ethylene-propylene copolymers, styrene-isoprene copolymers, hydrated styrene-isoprene copolymers, polyisobutylene, and dispersant type viscosity modifiers; pour point depressants such as polymethyl methacrylate; multifunctional additives such as sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound and the like.

Solid materials such as graphite, talc, metal powders, and various polymers such as polyethylene wax can also be added to impart special properties.

Properties

In one embodiment, the grease composition exhibits excellent extreme pressure properties as measured using ASTM D2596-10 ("Standard Test Method for Measurement of Extreme-Pressure Properties of Lubricating Grease (Four-Ball Method)"). In this test, two determinations can be made: the Load Wear Index and the Weld Point.

The Load Wear Index is a measure of the ability of a lubricant to prevent wear at applied loads. The greater the index, the better potential load bearing property of the grease. In one embodiment, the lubricating grease composition has a Load Wear Index rating of at least 85; in another embodiment, at least 100; in yet another embodiment, at least 115; in still yet another embodiment, at least 130.

The weld point is a measure of the lowest applied load at which sliding surfaces seize and then weld, indicating that the extreme pressure level of the lubricating grease has been exceeded. In one embodiment, the lubricating grease composition has a weld point of greater than 500 kg; e.g., at least 600 kg, or at least 700 kg, or at least 800 kg.

The pumpability performance of the grease composition at low temperature (−22° F.) was evaluated using the Lincoln Ventmeter Test method as described in "The Lubrication Engineers Manual," 3rd Edition, Association for Iron & Steel Technology, pp. 156-157, 2007. This test evaluates the ability of a grease to flow through a centralized lube system at lower temperatures.

EXAMPLES

The following examples are given to illustrate the present invention. It should be understood, however, that the invention is not to be limited to the specific conditions or details described in these examples.

Example 1

A lubricating grease composition was prepared by blending together the following components: 65.8 wt. % of a mixture of PAO base oils, 18.5 wt. % of a Li complex thickener, 2.5 wt. % of an extreme pressure agent, 5.0 wt. % of $MoS_2$, and 8.2 wt. % of anti-wear and other conventional additives.

Example 2

Inventive grease (Example 1) was compared against several commercial extra heavy duty extreme pressure greases designed for off-road applications. Commercial Grease A does not contain $MoS_2$. Commercial Grease B contains 5 wt. % $MoS_2$. The results are set forth in Table 1.

TABLE 1

| | Test Method | Example 1 | Grease A | Grease B |
|---|---|---|---|---|
| Properties | | | | |
| NLGI Grade | | 1 | 1.5 | 1 |
| Thickener Type | | Li Complex | Li Complex | Li Complex |
| Base Oil Type | | Synthetic Oil | Synthetic Oil | Mineral Oil |
| Base Oil Vis. @ 40° C. ($mm^2/s$) | ASTM D445 | 194 | 271 | 383 |
| Dropping Point (° C.) | ASTM D2265 | 262 | 312 | 265 |
| Penetration at 25° C., worked | ASTM D217 | 321 | 315 | 325 |
| Performance Test | | | | |
| Load Wear Index | ASTM D2596 | 135 | 79 | 75 |
| Weld Point, kg | ASTM D2596 | 800 | 500 | 500 |

TABLE 1-continued

| | Test Method | Example 1 | Grease A | Grease B |
|---|---|---|---|---|
| Pumpability @ −22° F. (psi) | Lincoln Ventmeter | 1676 | 725 | Too stiff to pump |

In comparison to other commercial heavy duty extreme pressure greases, the inventive grease demonstrated superior extreme pressure performance as evidenced in the Load Wear Index and Weld Point tests. In addition, the inventive grease demonstrated improved low temperature pumpability over commercial Grease B having the same concentration of $MoS_2$.

For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent. As used herein, the term "include" and its grammatical variants are intended to be non-limiting, such that recitation of items in a list is not to the exclusion of other like items that can be substituted or added to the listed items. As used herein, the term "comprising" means including elements or steps that are identified following that term, but any such elements or steps are not exhaustive, and an embodiment can include other elements or steps.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. To an extent not inconsistent herewith, all citations referred to herein are hereby incorporated by reference.

What is claimed is:

1. A lubricating grease composition comprising:

a) a major amount of a synthetic base oil having a kinematic viscosity at 40° C. from 150 $mm^2/s$ to 250 $mm^2/s$;

b) a lithium complex thickener;

c) 2.5 to 5 wt. % of at least one extreme pressure agent, based on a total weight of the lubricating grease composition; and d) 5 to 20 wt. % of molybdenum disulfide, based on the total weight of the lubricating grease composition;

wherein the at least one extreme pressure agent is selected from the group consisting of sulfurized animal or vegetable fats or oils; sulfurized animal or vegetable fatty acid esters; sulfurized olefins; dihydrocarbyl polysulfides; sulfurized Diels-Alder adducts; sulfurized dicyclopentadiene; sulfurized or co-sulfurized mixtures of fatty acid esters and mono-unsaturated olefins; co-sulfurized blends of fatty acids, fatty acid esters and alpha-olefins; functionally-substituted dihydrocarbyl polysulfides; thio-aldehydes; thio-ketones; epithio compounds; sulfur-containing acetal derivatives; co-sulfurized blends of terpene and acyclic olefins and polysulfide olefin products; and mixtures thereof, wherein the grease composition exhibits pumpability at −22° F.

2. The lubricating grease composition of claim 1, comprising 5 to 15 wt. % of molybdenum disulfide, based on the total weight of the lubricating grease composition.

3. The lubricating grease composition of claim 1, comprising 5 to 10 wt. % of molybdenum disulfide, based on the total weight of the lubricating grease composition.

4. The lubricating grease composition of claim 1, comprising 5 wt. % of molybdenum disulfide, based on the total weight of the lubricating grease composition.

5. The lubricating grease composition of claim 1, wherein the lubricating grease composition has a weld point of at least 700 kg as determined by ASTM D2596-10.

6. The lubricating grease composition of claim 1, wherein the lubricating grease composition has a weld point of at least 800 kg as determined by ASTM D2596-10.

7. The lubricating grease composition of claim 1, wherein a concentration of the lithium complex thickener in the lubricating grease composition ranges from 2 to 30 wt. %, based on the total weight of the lubricating grease composition.

8. The lubricating grease composition of claim 1, wherein the at least one extreme pressure agent is sulfurized olefins.

9. The lubricating grease composition of claim 1, comprising 6 wt % of molybdenum disulfide, based on the total weight of the lubricating grease composition.

10. The lubricating grease composition of claim 1, wherein a concentration of the synthetic base oil in the lubricating grease composition ranges from 55 to 90 wt. %, based on the total weight of the lubricating grease composition.

11. The lubricating grease composition of claim 1, wherein the lubricating grease composition has a load wear index rating of at least 85 as determined by ASTM D2596-10.

12. The lubricating grease composition of claim 1, wherein the synthetic base oil comprises at least one polyalphaolefin base oil.

13. The lubricating grease composition of claim 1, wherein the molybdenum disulfide has an average primary particle size of about 30 μm or less.

14. The lubricating grease composition of claim 1, wherein the molybdenum disulfide has an average primary particle size of 0.1 to 20 μm.

15. A method of making a lubricating grease composition consisting essentially of:

a) a major amount of a synthetic base oil;

b) a lithium complex thickener;

c) 2.5 to 5 wt. % of at least one extreme pressure agent, based on a total weight of the lubricating grease composition; and d) 5 to 20 wt. % of molybdenum disulfide, based on a total weight of the lubricating grease composition;

wherein the at least one extreme pressure agent is selected from the group consisting of sulfurized animal or vegetable fats or oils; sulfurized animal or vegetable fatty acid esters; sulfurized olefins; dihydrocarbyl polysulfides; sulfurized Diels-Alder adducts; sulfurized dicyclopentadiene; sulfurized or co-sulfurized mixtures of fatty acid esters and mono unsaturated olefins; co-sulfurized blends of fatty acids, fatty acid esters and alpha-olefins; functionally-substituted dihydrocarbyl polysulfides; thio-aldehydes; thio-ketones; epithio compounds; sulfur-containing acetal derivatives; co-sulfurized blends of terpene and acyclic olefins and polysulfide olefin products; and mixtures thereof, said method comprising: blending the synthetic base oil, lithium complex thickener, at least one extreme pressure agent, and molybdenum disulfide to for a lubricating grease composition; and isolating the lubricating grease composition.

16. The method of claim 15, wherein the at least one extreme pressure agent is sulfurized olefins.

17. A method comprising lubricating bearings, surfaces and other components with a lubricating grease composition which consists essentially of:

a) a major amount of a synthetic base oil;

b) a lithium complex thickener;

c) 2.5 wt. to 5 wt. % of at least one extreme pressure agent, based on a total weight of the lubricating grease composition; and d) 5 to 20 wt. % of molybdenum disulfide, based on a total weight of the lubricating grease composition;

wherein the at least one extreme pressure agent is selected from the group consisting of sulfurized animal or vegetable fats or oils; sulfurized animal or vegetable fatty acid esters; sulfurized olefins; dihydrocarbyl polysulfides; sulfurized Diels-Alder adducts; sulfurized dicyclopentadiene; sulfurized or co-sulfurized mixtures of fatty acid esters and mono-unsaturated olefins; co-sulfurized blends of fatty acids, fatty acid esters and alpha-olefins; functionally-substituted dihydrocarbyl polysulfides; thio-aldehydes; thio-ketones; epithio compounds; sulfur-containing acetal derivatives; co-sulfurized blends of terpene and acyclic olefins and polysulfide olefin products; and mixtures thereof.

18. The method of claim 17, wherein the at least one extreme pressure agent is sulfurized olefins.

19. A lubricating grease composition consisting essentially of:

a) a major amount of a synthetic base oil having a kinematic viscosity at 40° C. from 150 $mm^2/s$ to 250 $mm^2/s$;

b) a lithium complex thickener;

c) 2.5 to 5 wt. % of at least one extreme pressure agent, based on a total weight of the lubricating grease composition; and d) 5 to 20 wt. % of molybdenum disulfide, based on the total weight of the lubricating grease composition;

wherein the at least one extreme pressure agent is selected from the group consisting of sulfurized animal or vegetable fats or oils; sulfurized animal or vegetable fatty acid esters; sulfurized olefins; dihydrocarbyl polysulfides; sulfurized Diels-Alder adducts; sulfurized dicyclopentadiene; sulfurized or co-sulfurized mixtures of fatty acid esters and mono-unsaturated olefins; co-sulfurized blends of fatty acids, fatty acid esters and alpha-olefins; functionally-substituted dihydrocarbyl polysulfides; thio-aldehydes; thio-ketones; epithio compounds; sulfur-containing acetal derivatives; co-sulfurized blends of terpene and acyclic olefins and polysulfide olefin products; and mixtures thereof.

20. The lubricating grease composition of claim 19, wherein the molybdenum disulfide is present in an amount of 5 to 10 wt. %, based on the total weight of the lubricating grease composition.

* * * * *